US011569028B2

(12) United States Patent
Hashida et al.

(10) Patent No.: US 11,569,028 B2
(45) Date of Patent: Jan. 31, 2023

(54) INTERNAL COMBUSTION ENGINE IGNITION COIL

(71) Applicant: Mitsubishi Electric Corporation, Tokyo (JP)

(72) Inventors: Chikara Hashida, Tokyo (JP); Shuji Yamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 269 days.

(21) Appl. No.: 16/975,178

(22) PCT Filed: Apr. 18, 2018

(86) PCT No.: PCT/JP2018/015935
§ 371 (c)(1),
(2) Date: Aug. 24, 2020

(87) PCT Pub. No.: WO2019/202674
PCT Pub. Date: Oct. 24, 2019

(65) Prior Publication Data

US 2021/0118612 A1 Apr. 22, 2021

(51) Int. Cl.
*H01F 38/12* (2006.01)
*H01F 27/24* (2006.01)
(Continued)

(52) U.S. Cl.
CPC ..... *H01F 38/12* (2013.01); *F02P 3/02* (2013.01); *H01F 27/24* (2013.01); *H01F 27/28* (2013.01);
(Continued)

(58) Field of Classification Search
CPC ..... H01F 38/12; H01F 27/28; F02P 3/02
See application file for complete search history.

(56) References Cited

U.S. PATENT DOCUMENTS

2006/0226945 A1 10/2006 Maekawa et al.
2012/0103313 A1 5/2012 Idogawa et al.
(Continued)

FOREIGN PATENT DOCUMENTS

DE 10 2006 044 436 A1 3/2008
JP 58-166712 A 10/1983
(Continued)

OTHER PUBLICATIONS

Office Action dated Jun. 1, 2021 from the Japanese Patent Office in Patent Application No. 2020-514836.
(Continued)

*Primary Examiner* — Phutthiwat Wongwian
*Assistant Examiner* — Arnold Castro
(74) *Attorney, Agent, or Firm* — Sughrue Mion, PLLC; Richard C. Turner

(57) ABSTRACT

An internal combustion engine ignition coil includes: a center core; a primary coil provided on an outer side of the center core; a secondary coil provided on an outer side of the primary coil; and a side core provided on an outer side of the primary coil and the secondary coil and formed by stacked electromagnetic steel sheets, the side core having one contact portion in contact with one end surface of the center core and another contact portion in contact with another end surface of the center core with a magnet therebetween. The side core is composed of a plurality of side core portions fitted to each other to be movable relative to each other in a longitudinal direction of the center core.

9 Claims, 15 Drawing Sheets

(51) Int. Cl.

| | |
|---|---|
| ***F02P 3/02*** | (2006.01) |
| ***H01F 27/28*** | (2006.01) |
| ***H01F 41/02*** | (2006.01) |
| ***H01F 41/06*** | (2016.01) |

(52) U.S. Cl.
CPC ..... *H01F 41/0206* (2013.01); *H01F 41/06* (2013.01)

(56) References Cited

U.S. PATENT DOCUMENTS

| | | | | |
|---|---|---|---|---|
| 2017/0309397 | A1* | 10/2017 | Kawai | H01F 27/022 |
| 2021/0074473 | A1* | 3/2021 | Yamada | H01F 27/28 |
| 2021/0233704 | A1* | 7/2021 | Torii | H01F 27/26 |
| 2021/0265107 | A1* | 8/2021 | Suzuki | H01F 38/12 |

FOREIGN PATENT DOCUMENTS

| | | | |
|---|---|---|---|
| JP | 60-96806 | U | 7/1985 |
| JP | 2002-281697 | A | 9/2002 |
| JP | 2005-260130 | A | 9/2005 |
| JP | 2006-294914 | A | 10/2006 |
| JP | 2012-099537 | A | 5/2012 |
| JP | 5192531 | B2 | 5/2013 |
| JP | 2017-092072 | A | 5/2017 |

OTHER PUBLICATIONS

International search report for PCT/JP2018/015935 dated Jul. 17, 2018.

* cited by examiner

INTERNAL COMBUSTION ENGINE IGNITION COIL

CROSS-REFERENCE TO RELATED APPLICATIONS

This application is a National Stage of International Application No. PCT/JP2018/015935 filed on Apr. 18, 2018.

TECHNICAL FIELD

The present disclosure relates to an internal combustion engine ignition coil for supplying high voltage to a spark plug of an internal combustion engine.

BACKGROUND ART

It has been known that: cores of a closed magnetic path configuration used for a conventional internal combustion engine ignition coil include a center core disposed on the inner side of a primary coil and a secondary coil, and a side core having one end surface in contact with one end surface of the center core and the other end surface in contact with the other end surface of the center core with a magnet therebetween; and the side core is divided into two pieces, and thus, even if the dimensions of the center core, the magnet, and the side core are slightly changed, workability of assembling the components is prevented from deteriorating (see, for example, Patent Document 1).

In addition, the following configuration has been proposed: a configuration in which a side core is composed of a plurality of side core portions formed by stacked electromagnetic steel sheets divided at different locations in a longitudinal direction, an overlap portion at which the electromagnetic steel sheets of the side core portions adjacent to each other overlap with each other between the different locations in the longitudinal direction is provided, and positioning portions that allow rotational movement only in such a direction as to open the side core portions with respect to each other are formed at the overlap portion, thereby suppressing increase in a magnetic circuit resistance without causing assembling workability to deteriorate (see, for example, Patent Document 2).

CITATION LIST

Patent Document

Patent Document 1: Japanese Laid-Open Patent Publication No. 2006-294914
Patent Document 2: Japanese Patent No. 5192531

SUMMARY OF THE INVENTION

Problems to be Solved by the Invention

In the above-described Patent Document 1, the side core is divided into two pieces. Thus, the number of parts and the number of steps increase. Furthermore, a magnetic circuit resistance is generated owing to shifting between division surfaces, resulting in reduction in the performance of the ignition coil. It has been known to form the division surfaces in a slanted manner in order to reduce the shifting between the division surfaces. However, from a micro viewpoint, variation in production occurs owing to, for example, a shear droop at the time of stamping a core with a die, and this variation makes it impossible to avoid the factor in occurrence of the magnetic circuit resistance.

The above-described Patent Document 2 solves the problems of the above-described Patent Document 1 by allowing rotation in the direction of the opening of the side core. However, Patent Document 2 has a problem in that, if the lengths of a center core and a magnet increase, the side core and the center core cannot be kept in contact with each other at surfaces thereof, resulting in increase in the magnetic circuit resistance. In addition, Patent Document 2 has another problem in that it is difficult to produce a side core having a shape other than a substantially U shape.

The present disclosure has been made to solve the aforementioned problems, and an object of the present disclosure is to provide an internal combustion engine ignition coil capable of suppressing increase in a magnetic circuit resistance without causing assembling workability to deteriorate.

Solution to the Problems

An internal combustion engine ignition coil according to the present disclosure includes: a center core; a primary coil provided on an outer side of the center core; a secondary coil provided on an outer side of the primary coil; and a side core provided on an outer side of the primary coil and the secondary coil and formed by stacked electromagnetic steel sheets, the side core having one contact portion in contact with one end surface of the center core, the side core having another contact portion in contact with another end surface of the center core with a magnet therebetween. The side core is composed of a plurality of side core portions fitted to each other to be movable relative to each other in a longitudinal direction of the center core.

Effect of the Invention

The internal combustion engine ignition coil according to the present disclosure makes it possible to obtain an internal combustion engine ignition coil capable of suppressing increase in a magnetic circuit resistance without causing assembling workability to deteriorate.

DESCRIPTION OF EMBODIMENTS

Figure 1:
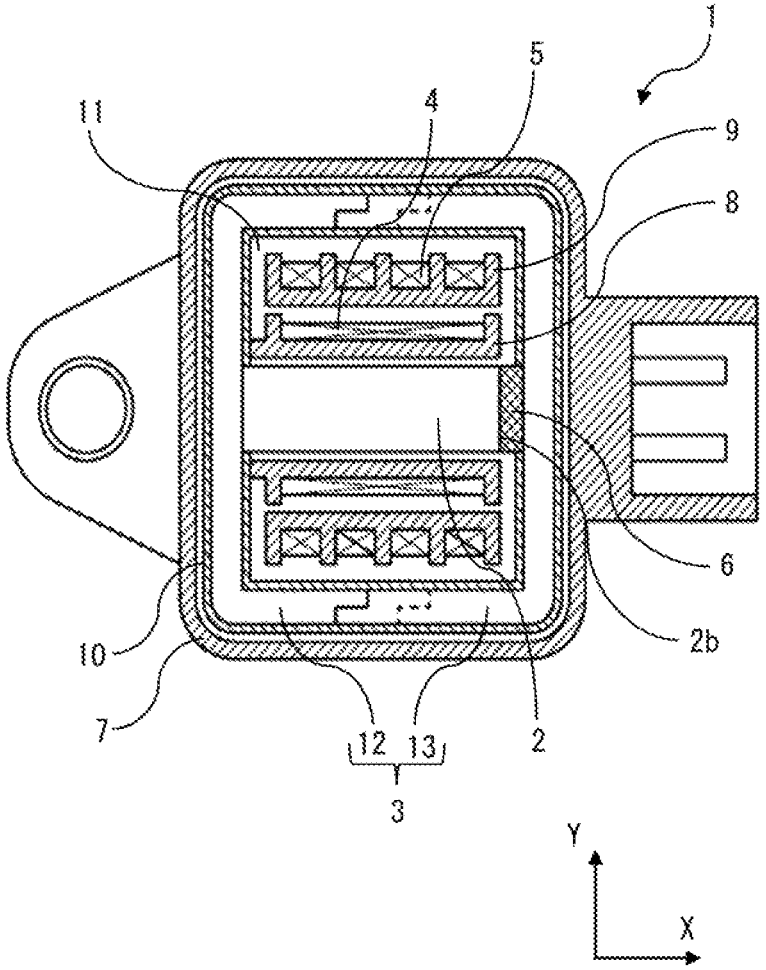
FIG. 1 is a cross-sectional view schematically showing an internal combustion engine ignition coil according to embodiment 1.

Hereinafter, internal combustion engine ignition coils according to embodiments will be described with reference to the drawings. In the description, the same or corresponding members and portions in the drawings are denoted by the same reference characters.

Embodiment 1

Figure 2:
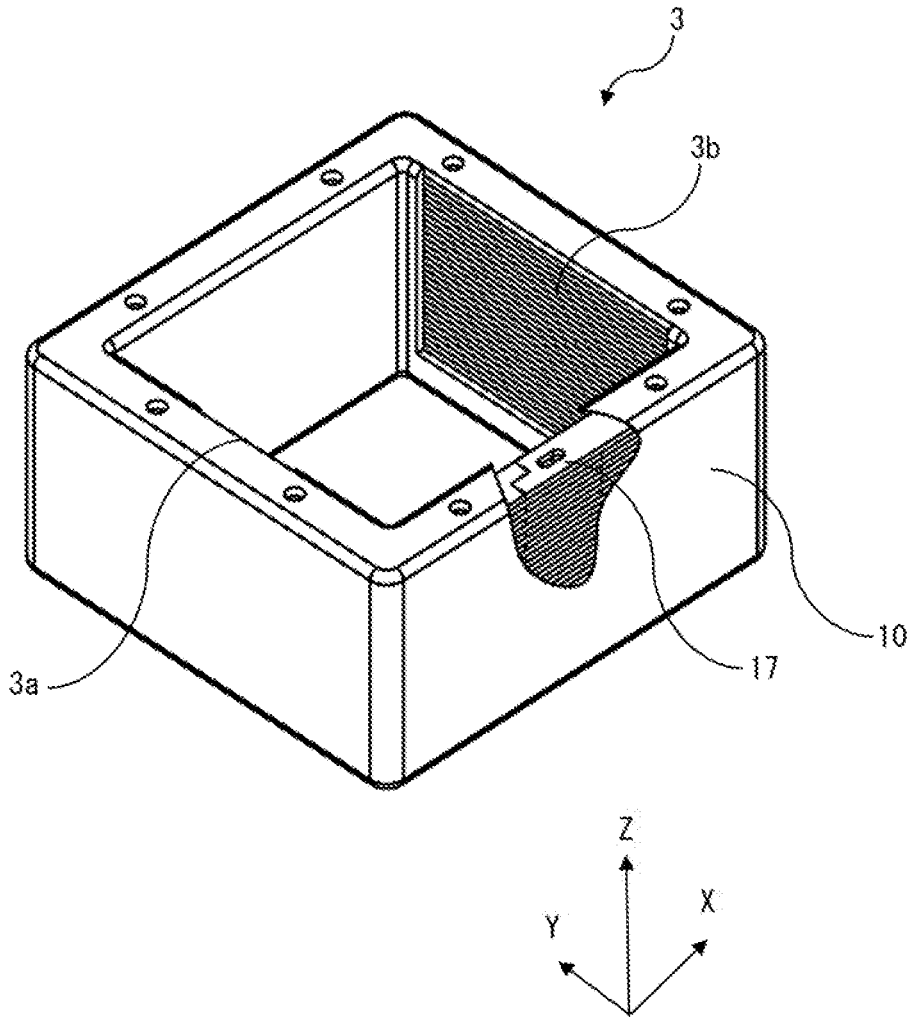
FIG. 2 is a perspective view of a side core in embodiment 1.
Figure 3:
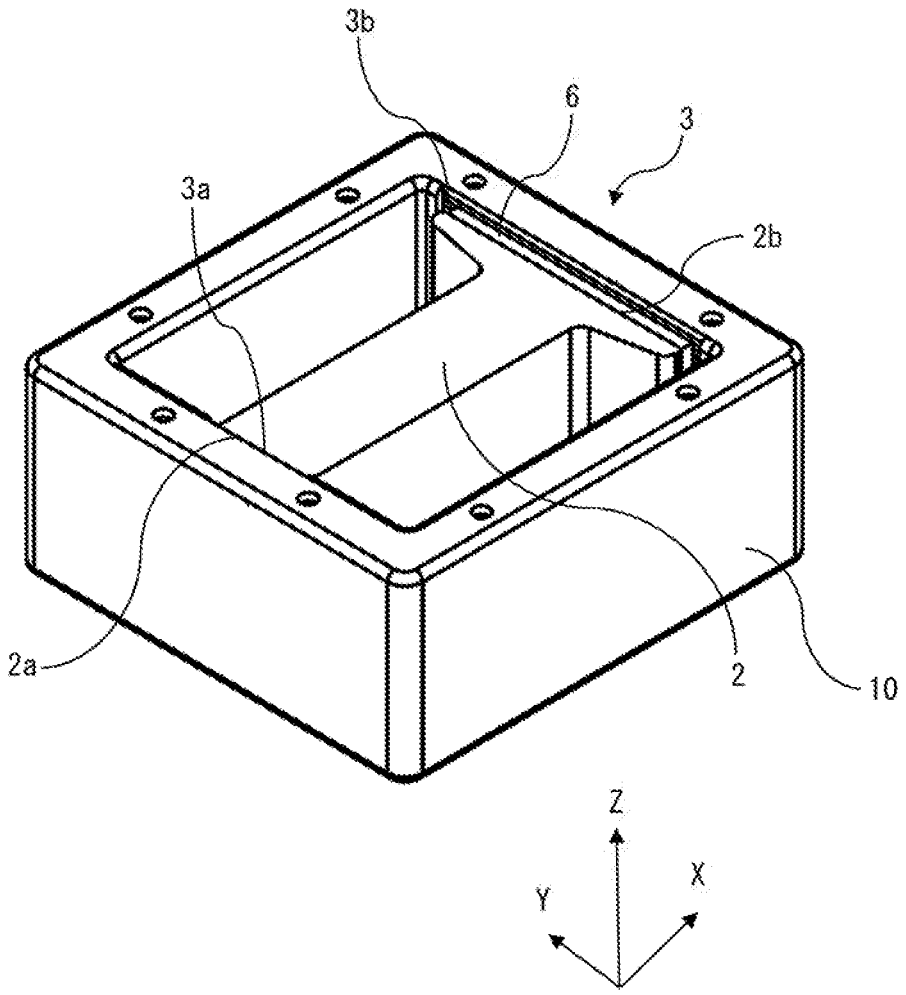
FIG. 3 is a perspective view of a center core and the side core in embodiment 1.

A schematic configuration of an internal combustion engine ignition coil 1 according to embodiment 1 will be described. FIG. 1 is a cross-sectional view schematically showing a configuration of the internal combustion engine ignition coil 1. FIG. 2 is a perspective view of a side core 3. FIG. 3 is a perspective view of a center core 2 and the side core 3. The internal combustion engine ignition coil 1 is mounted mainly to a vehicular internal combustion engine, e.g., an internal combustion engine for automobiles. The internal combustion engine ignition coil 1 supplies high voltage to a spark plug, to cause spark discharge.

In FIG. 1, the internal combustion engine ignition coil 1 is composed of the center core 2, the side core 3, a primary coil 4, a secondary coil 5, and a magnet 6. These components are accommodated inside a case 7 so as to be fixed by an insulation resin 11 which is a thermosetting epoxy resin. The center core 2 is a substantially I-shaped core formed by stacking electromagnetic steel sheets. The primary coil 4 is provided on the outer side of the center core 2, and the secondary coil 5 is provided on the outer side of the primary coil 4. The primary coil 4 and the secondary coil 5 are respectively wound around and retained by a primary bobbin 8 and a secondary bobbin 9 made of a resin material. The magnet 6 magnetized in a direction opposite to the direction of magnetic flux caused by energization of the primary coil 4 is brought into contact with one end surface 2*b* of the center core 2. The side core 3 which is O-shaped and forms a closed magnetic path together with the center core 2 and the magnet 6, is provided on the outer side of the secondary coil 5. The side core 3 is formed by stacked electromagnetic steel sheets and composed of two pairs of side core portions (a first side core portion 12 and a second side core portion 13) fitted to each other to be movable relative to each other in the longitudinal direction of the center core 2. As shown in FIG. 2, the side core 3 is, at the portions thereof excluding contact portions 3*a* and 3*b* in contact with the center core 2 and the magnet 6, covered by a core cover 10 made of, for example, a thermoplastic elastomer that is an elastic resin material and that is flexible. In FIG. 2, a portion of the core cover 10 around a fitting portion 17 (described later) is cut such that the fitting portion 17 can be seen. However, the side core 3 is, at the portions thereof excluding the contact portions 3*a* and 3*b* but including the fitting portion 17, covered by the core cover 10. As shown in FIG. 3, the side core 3 is, at the contact portion 3*a* which is a surface portion of the inner peripheral surface thereof, in contact with one end surface 2*a* of the center core 2. Meanwhile, the side core 3 is, at the contact portion 3*b* which is a surface opposite to the contact portion 3*a*, in contact with another end surface 2*b* of the center core 2 with the magnet 6 therebetween.

Figure 4:
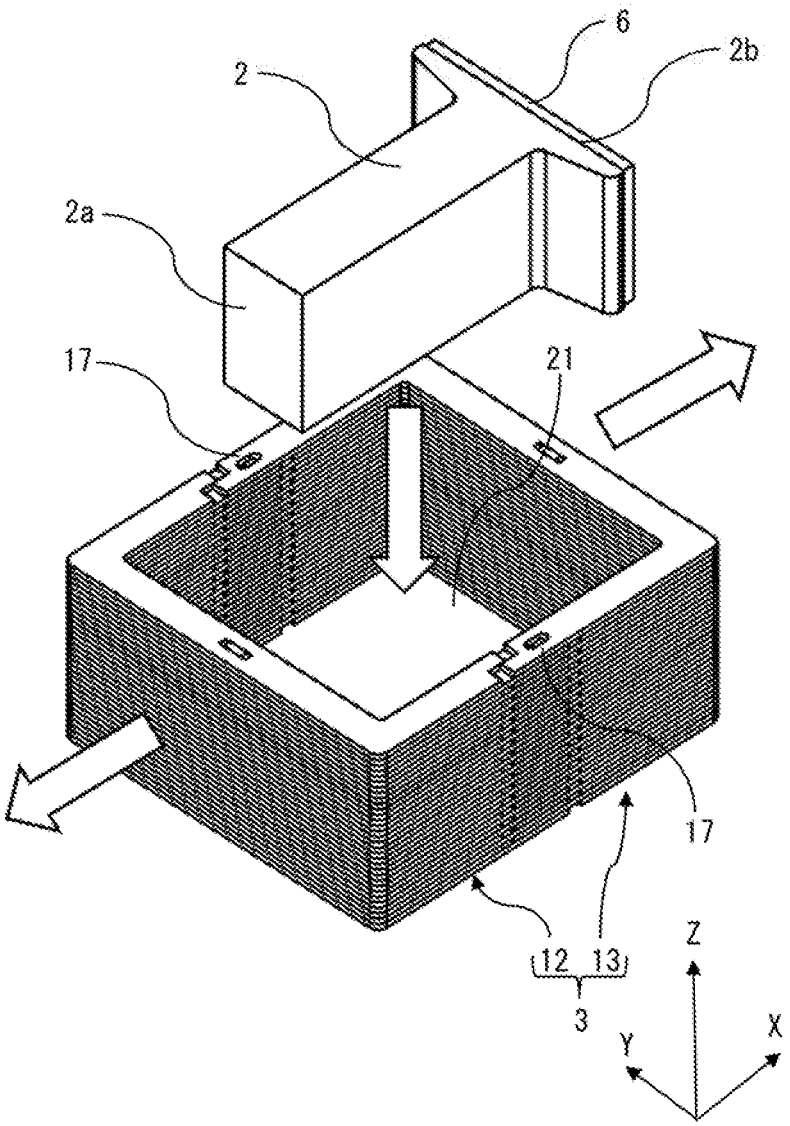
FIG. 4 is a diagram for explanation about accommodation of the center core in the side core, in embodiment 1.
Figure 5:
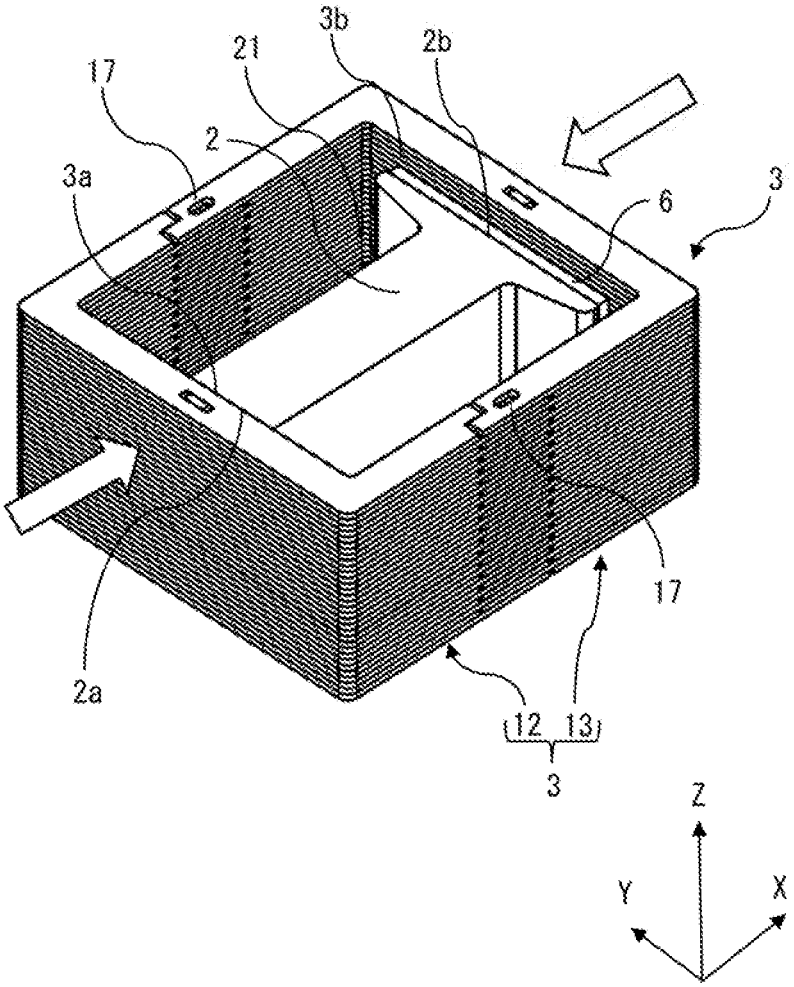
FIG. 5 is a diagram for explanation about accommodation of the center core in the side core, in embodiment 1.

Accommodation of the center core 2 in the side core 3 will be described. FIG. 4 and FIG. 5 are each a diagram for explanation about accommodation of the center core 2 in the side core 3. For simplification, FIG. 4 and FIG. 5 do not show any of the primary coil 4, the secondary coil 5, and the core cover 10. Fitting portions 17 for expanding an internal space 21 of the side core 3 in an X direction are formed at the locations at which the first side core portion 12 and the second side core portion 13 are coupled to each other. First, as shown in FIG. 4, the fitting portions 17 of the side core 3 are elongated to expand the internal space 21 of the side core 3 in the X direction. Then, the center core 2 provided with the magnet 6 is put into the internal space 21. Then, as shown in FIG. 5, the fitting portions 17 of the side core 3 are shortened such that the contact portion 3*a* and the contact portion 3*b* respectively come into contact with the one end surface 2*a* of the center core 2 and the magnet 6. Accordingly, the internal space 21 of the side core 3 is shrunk in the X direction. If the center core 2 is accommodated in the side core 3 in this manner, variations in the dimensions in the X direction of the center core 2 and the magnet 6 are eliminated by the fitting portions 17. Thus, contact between the center core 2 and the side core 3 can be ensured. The side core 3 is provided with the core cover 10 as shown in FIG. 2, and the core cover 10 is formed of an elastic resin material and enables a work to be performed while being stretched and contracted. Therefore, movements of the first side core portion 12 and the second side core portion 13 are not hindered, whereby workability is improved.

Figure 6:
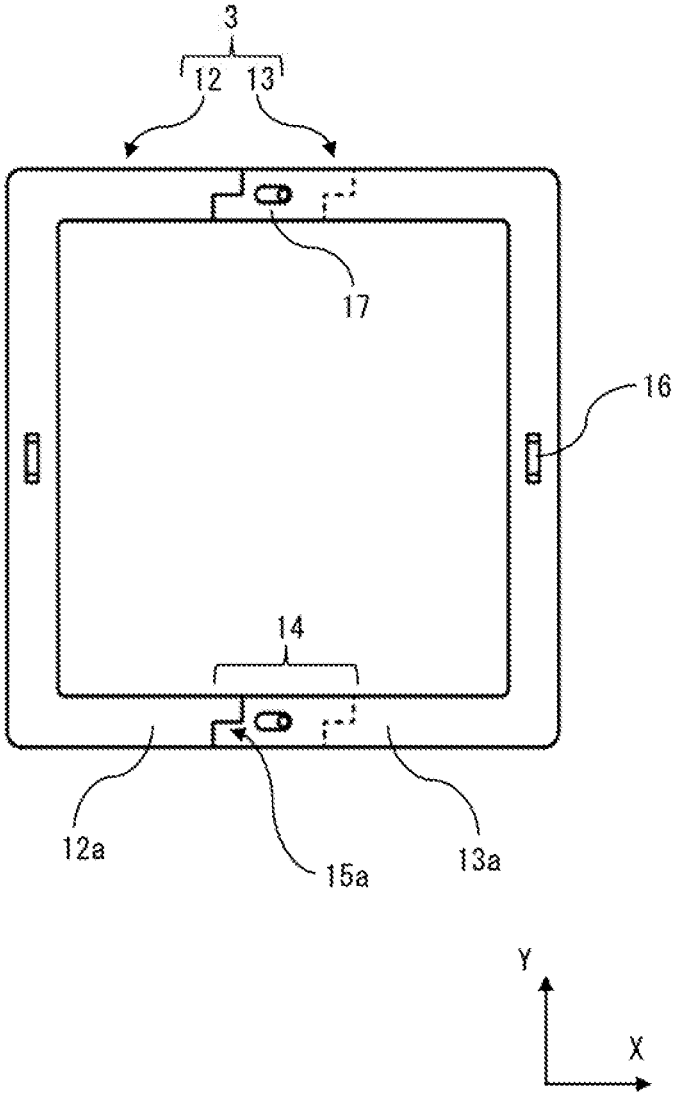
FIG. 6 is a top view of the side core in embodiment 1.
Figure 7:
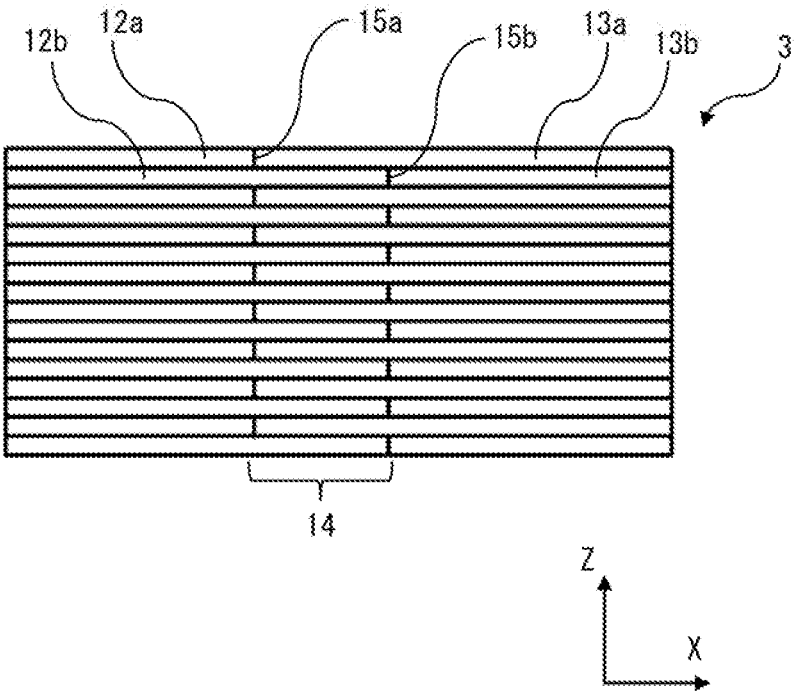
FIG. 7 is a side view of the side core in embodiment 1.
Figure 8:
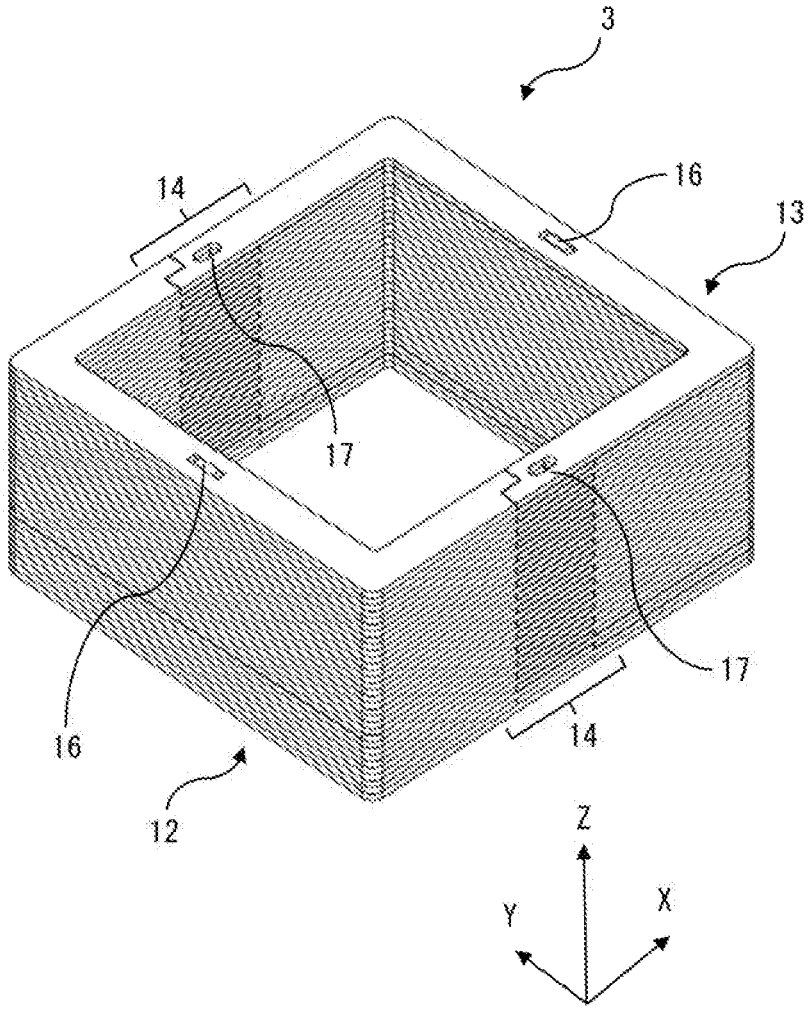
FIG. 8 is a perspective view of the side core in embodiment 1.
Figure 9:
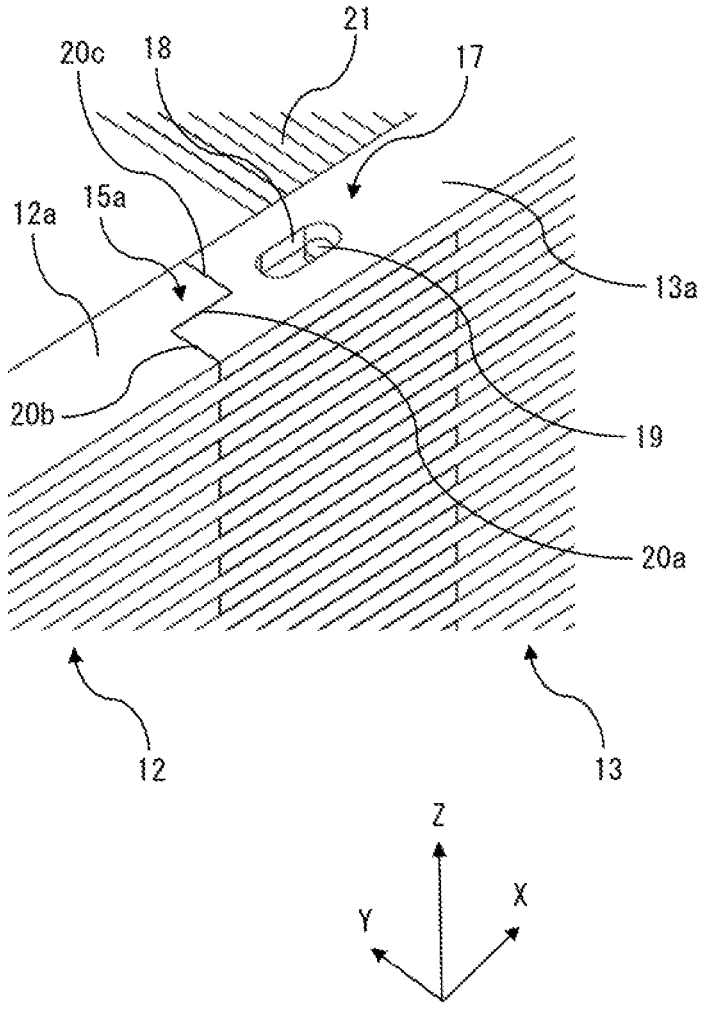
FIG. 9 is a partially enlarged perspective view of the side core in embodiment 1.

Next, a configuration of the side core 3 will be described. FIG. 6 is a top view of the side core 3. FIG. 7 is a side view of the side core 3. FIG. 8 is a perspective view of the side core 3. FIG. 9 is an enlarged perspective view of the fitting portion 17 of the side core 3 shown in FIG. 8. In FIG. 6, the side core 3 is formed in an O shape by combining the first side core portion 12 and the second side core portion 13, which each have a U shape, with each other. The side core 3 has overlap portions 14 at which the electromagnetic steel sheets forming the first side core portion 12 and the second side core portion 13 adjacent to each other are separated at locations different between each layer and overlap with each other. In FIG. 7, in a first-layer electromagnetic steel sheet, contact sections 15*a* of a first side core portion 12*a* and a second side core portion 13*a* are in contact with each other. Each contact section 15*a* is the division location between the first side core portion 12*a* and the second side core portion 13*a*. Likewise, in a second-layer electromagnetic steel sheet, contact sections 15*b* of a first side core portion 12*b* and a second side core portion 13*b* are in contact with each other. Each contact section 15*b* is the division location between the first side core portion 12*b* and the second side core portion 13*b*. The portion between the contact section 15*a* and the contact section 15*b* is the overlap portion 14.

In FIG. 8, swaged portions 16 are formed on each of the first side core portion 12 and the second side core portion 13. The swaged portions 16 are projections formed on each of the stacked electromagnetic steel sheets. The individual electromagnetic steel sheets are positioned and fixed by being stacked such that the swaged portions 16 are superposed on each other. In the present embodiment, the swaged portions 16 are formed at one location on each of the first side core portion 12 and the second side core portion 13. However, the present disclosure is not limited thereto, and the positions, the shapes, and the number of the swaged portions 16 to be formed may be changed.

Figure 10:
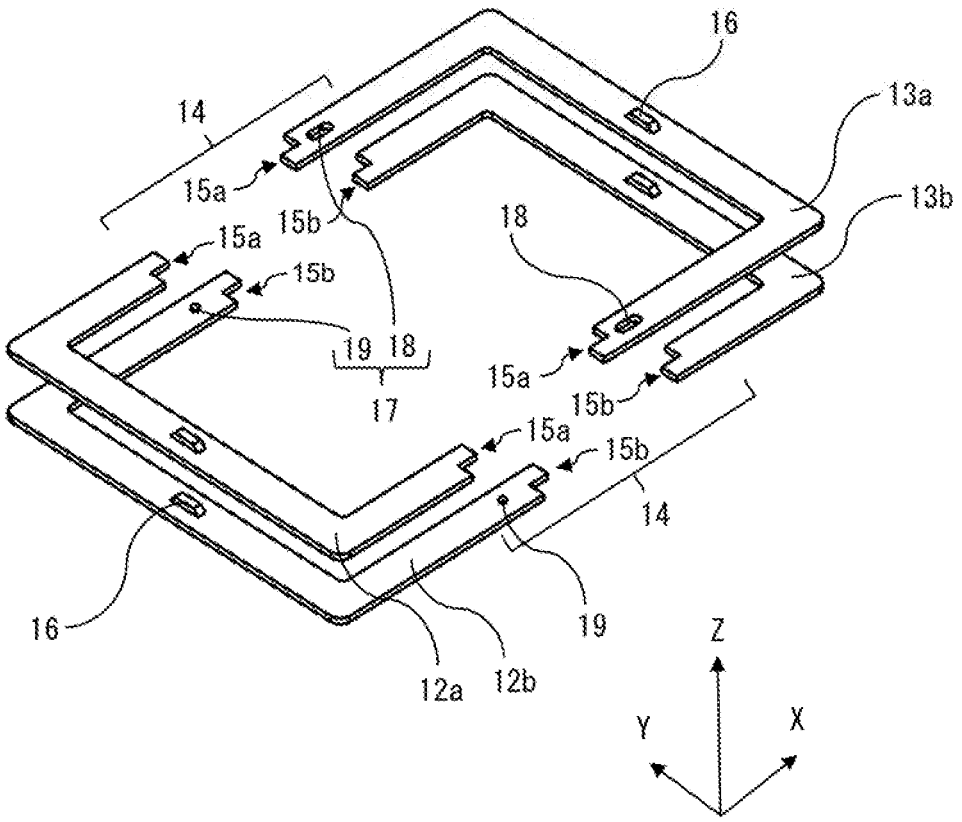
FIG. 10 is an exploded perspective view of some of stacked steel sheets of the side core in embodiment 1.

As shown in FIG. 8, the side core 3 has the fitting portion 17 at two locations. The fitting portions 17 allow the first side core portion 12 and the second side core portion 13 adjacent to each other to move in the X direction relative to each other. As shown in FIG. 9, each fitting portion 17 is formed by fitting a projection 19, which is formed on a lower-layer electromagnetic steel sheet, to an elongated hole 18 formed in an upper-layer electromagnetic steel sheet. In FIG. 9, the first side core portion 12 and the second side core portion 13 have not been moved in such a direction as to expand the internal space 21, and the contact sections 15*a* are in contact with each other at three contact surfaces 20*a*, 20*b*, and 20*c* of each contact section 15*a*. The fitting portions 17 will be described in detail with reference to FIG. 10. FIG. 10 is an exploded perspective view of some of the electromagnetic steel sheets of the side core 3. A pair of fitting portions 17 are formed by two layers of electromagnetic steel sheets located on upper and lower sides. In FIG. 10, the upper layer is formed by the electromagnetic steel sheets of the first side core portion 12*a* and the second side core portion 13*a*, and the lower layer is formed by the electromagnetic steel sheets of the first side core portion 12*b* and the second side core portion 13*b*. The projection 19 is provided at each end portion, of the first side core portion 12*b*, that forms the corresponding overlap portion 14. The elongated hole 18 having a diameter elongated in the X direction of the center core is provided in each end portion, of the second side core portion 13*a*, that forms the overlap portion 14. The direction in which the diameter is elongated, is the direction in which the first side core portion 12 and the second side core portion 13 move. First, the contact sections 15*b* are brought into contact with each other to set the first side core portion 12*b* and the second side core portion 13*b*. The contact sections 15*a* are brought into contact with each other to set the first side core portion 12*a* and the second side core portion 13*a* on the first side core portion 12*b* and the second side core portion 13*b* such that: the swaged portions 16 are superposed on each other; and the elongated holes 18 are fitted to the projections 19. If the elongated holes 18 and the projections 19 are fitted to each other in this manner, the projections 19 are movable in the direction in which the diameters of the elongated holes 18 are elongated. Thus, the first side core portion 12 and the second side core portion 13 move in the X direction.

Figure 11:
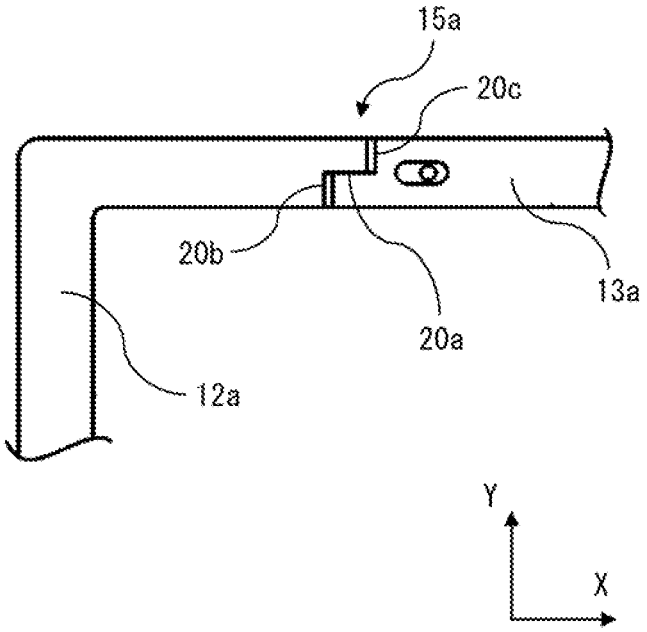
FIG. 11 is a partially enlarged top view of the side core in embodiment 1.

The contact sections 15*a* during movement of the first side core portion 12 and the second side core portion 13 will be described with reference to FIG. 11. FIG. 11 is an enlarged top view of the contact sections 15*a* of the first side core portion 12*a* and the second side core portion 13*a*. When no movement is made, the contact sections 15*a* are in contact with each other at the three contact surfaces 20*a*, 20*b*, and 20*c* as shown in FIG. 9. Meanwhile, when a movement is made, only the contact at the contact surface 20*a* is kept, and the first side core portion 12*a* and the second side core portion 13*a* are apart from each other at the other contact surfaces, i.e., the contact surfaces 20*b* and 20*c*. The reason why the contact at the contact surface 20*a* is kept is because the contact surface 20*a* is formed in the same direction as the direction of the movement.

Figure 12:
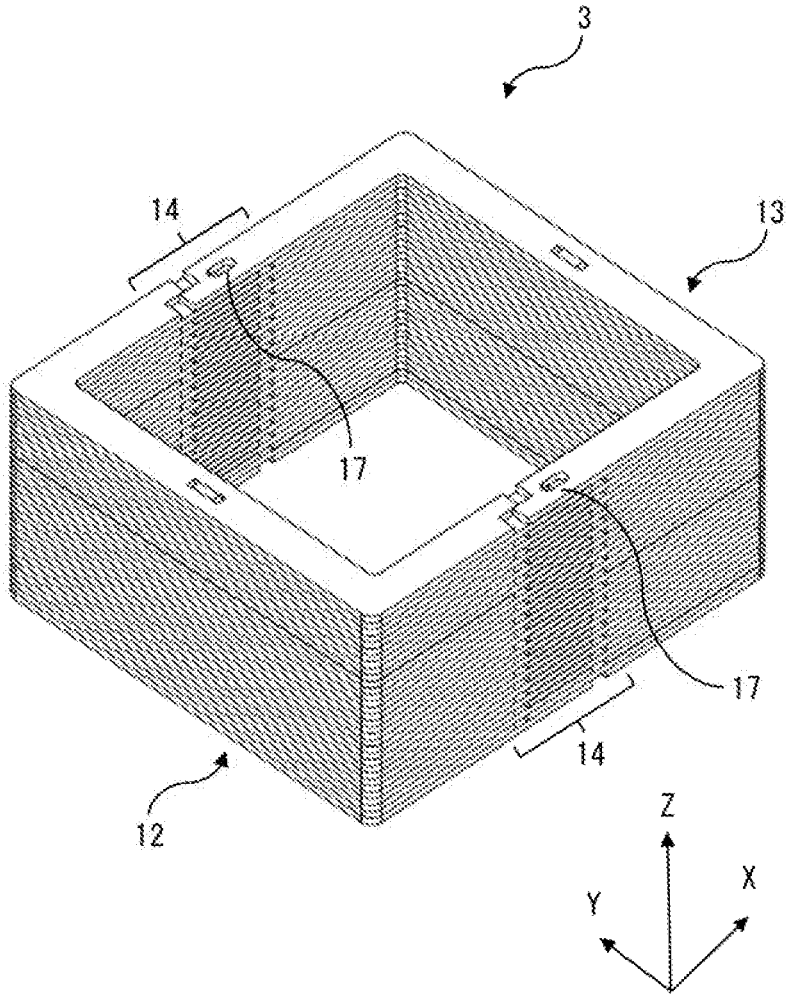
FIG. 12 is a perspective view of the side core after movement, in embodiment 1.
Figure 13:
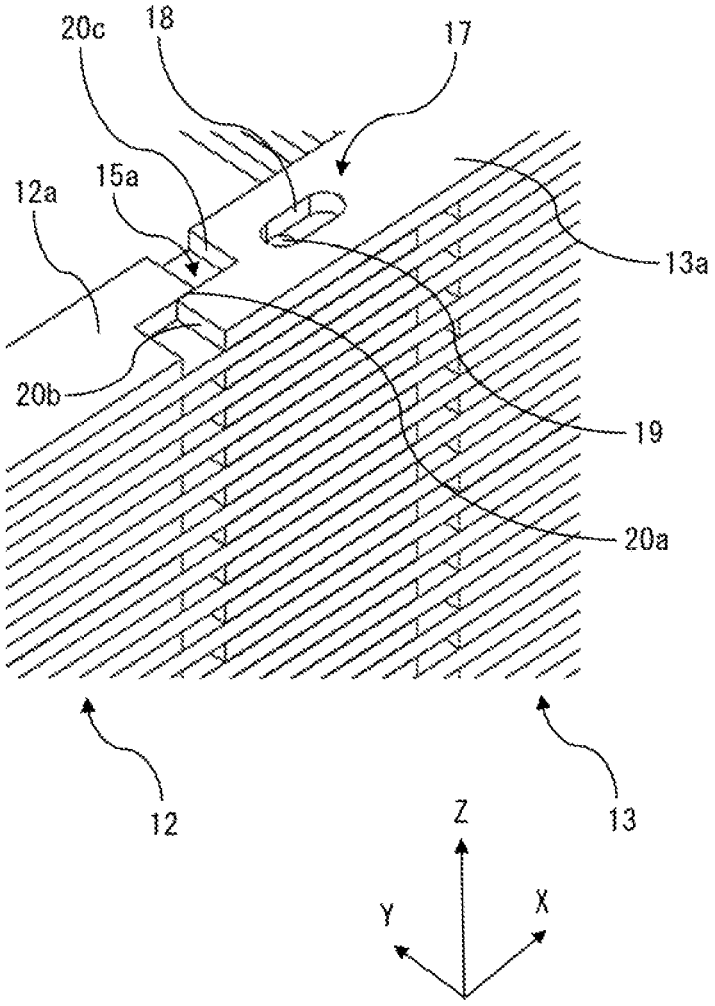
FIG. 13 is a partially enlarged perspective view of the side core after movement, in embodiment 1.

The side core 3 after the movement will be described. FIG. 12 is a perspective view of the side core 3 after the movement. FIG. 13 is an enlarged perspective view of the fitting portion 17 of the side core 3 shown in FIG. 12. Each projection 19 moves in the direction in which the diameters of the elongated holes 18 are elongated, and the movement is ended when the projection 19 comes into contact with a side surface of the corresponding elongated hole 18. The side core 3 is expanded in the X direction by a distance for which the projection 19 has moved in the elongated hole 18. As shown in FIG. 13, the contact at the contact surface 20*a* is kept even at the end of the movement. This is because the contact surface 20*a* is formed such that the length thereof in the X direction is longer than the distance in the X direction for which the projection 19 is allowed to move in the elongated hole 18. The side core 3 moves while keeping the contact at the contact surface 20*a*, and thus, even if the size in the longitudinal direction of the center core 2 inclusive of the magnet 6 is increased within a range for the movement of the side core 3, increase in a magnetic circuit resistance can be suppressed. In the present embodiment, a configuration in which the elongated hole 18 is formed and the projection 19 is fitted thereto, has been employed. However, the present disclosure is not limited to this configuration, and a configuration in which a counterbore is formed instead of the elongated hole 18 and the projection 19 is fitted thereto, may be employed.

As described above, in the internal combustion engine ignition coil 1, the side core 3 is composed of the first side core portion 12 and the second side core portion 13 separated from each other, and the fitting portions 17 which allow movement are formed at the overlap portions 14 between the first side core portion 12 and the second side core portion 13. Accordingly, the first side core portion 12 and the second side core portion 13 do not become apart from each other, and thus the internal combustion engine ignition coil 1 can be assembled without causing assembling workability for the internal combustion engine ignition coil 1 to deteriorate. In addition, the center core 2 and the magnet 6 can be accommodated by moving the first side core portion 12 and the second side core portion 13 by means of the fitting portions 17. Thus, even if the lengths of the center core 2 and the magnet 6 are increased, the side core 3 and the center core 2 can be kept in contact with each other at the surfaces thereof, whereby increase in the magnetic circuit resistance can be suppressed. In addition, since the side core 3 is covered by the core cover 10 made of an elastic resin material, workability of moving the side core 3 can be improved. In addition, since the core cover 10 serves as a cushioning member between the insulation resin 11 and the side core 3, the core cover 10 can prevent the insulation resin 11 from cracking when heat stress is applied to the internal combustion engine ignition coil 1.

In the present embodiment 1, the example has been described in which: the first side core portion 12 and the second side core portion 13 are used as the two side core portions; and the fitting portions 17 on the overlap portions 14 are provided at two locations. However, two or more side core portions may be used, and the fitting portions may be provided at a plurality of locations.

In addition, in the present embodiment 1, the configuration has been described in which the division locations are shifted between each layer of electromagnetic steel sheet. However, the division locations of a plurality of groups of layers may be collectively shifted, and the fitting portions may be provided to some of the layers.

Embodiment 2

Figure 14:
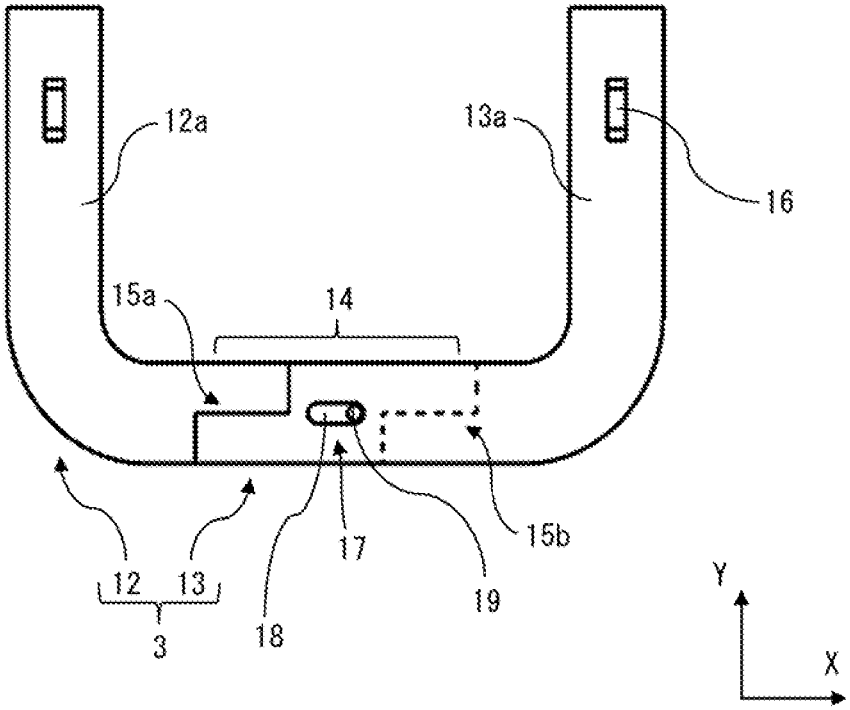
FIG. 14 is a top view of a side core in embodiment 2.

A configuration of an internal combustion engine ignition coil 1 according to embodiment 2 will be described. FIG. 14 is a top view of a side core 3 of the internal combustion engine ignition coil 1. In embodiment 1, the side core 3 is formed in an O shape by using the two side core portions each having a substantially U shape. Meanwhile, in embodiment 2, the side core 3 is formed in a U shape by using two side core portions each having an L shape. The other components are the same as those in embodiment 1. Thus, the other components are denoted by the same reference characters, and description thereof is omitted.

The side core 3 is formed in a U shape by combining a first side core portion 12 and a second side core portion 13 each having an L shape. The side core 3 has overlap portions 14 at which the electromagnetic steel sheets forming the first side core portion 12 and the second side core portion 13 adjacent to each other are separated at locations different between each layer and overlap with each other. In a first-layer electromagnetic steel sheet, contact sections 15*a* of a first side core portion 12*a* and a second side core portion 13*a* are in contact with each other. Each contact section 15*a* is the division location between the first side core portion 12*a* and the second side core portion 13*a*. Likewise, in a second-layer electromagnetic steel sheet, contact sections 15*b* indicated by the broken line are in contact with each other. The portion between the contact section 15*a* and the contact section 15*b* is the overlap portion 14.

The side core 3 has fitting portions 17 at one location. The fitting portions 17 allow the first side core portion 12 and the second side core portion 13 adjacent to each other to move in the X direction relative to each other. Each fitting portion 17 is formed by fitting a projection 19, which is formed on a lower-layer electromagnetic steel sheet, to an elongated hole 18 formed in an upper-layer electromagnetic steel sheet.

Figure 15:
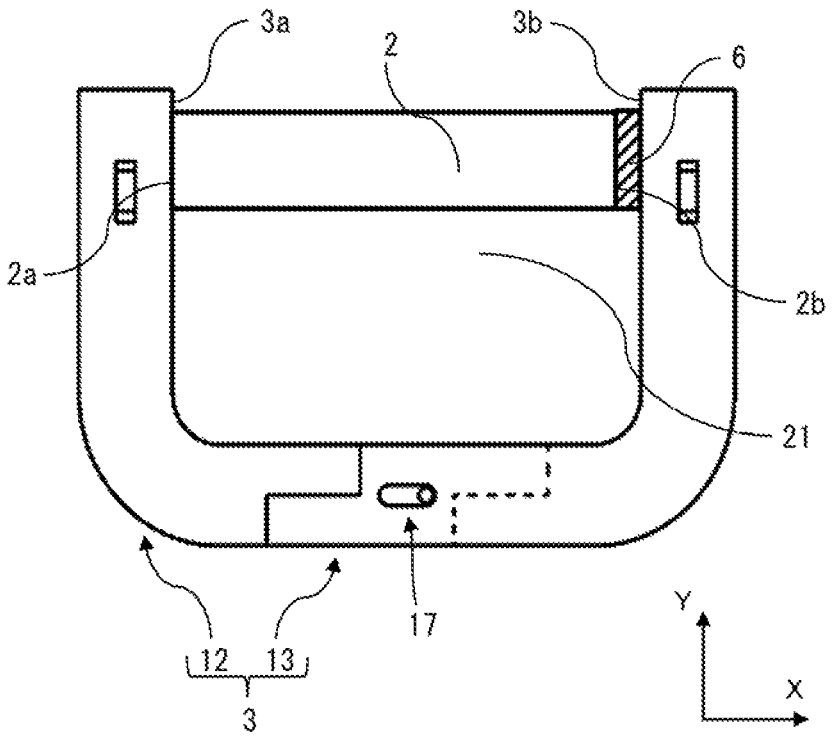
FIG. 15 is a top view of the center core and the side core in embodiment 2.

Next, contact portions between the center core 2 and the side core 3 will be described. FIG. 15 is a top view of the center core 2 and the side core 3. The side core 3 is, at a contact portion 3*a* which is a surface portion of the inner peripheral surface thereof, in contact with the one end surface 2*a* of the center core 2. Meanwhile, the side core 3 is, at a contact portion 3*b* which is another surface portion thereof opposite to the contact portion 3*a*, in contact with the other end surface 2*b* of the center core 2 with the magnet 6 therebetween.

A procedure for achieving the contact will be described. Movement is made by means of the fitting portions 17 of the side core 3 so as to expand the internal space 21 of the side core 3 in the X direction, and thereafter, the center core 2 provided with the magnet 6 is put into the internal space 21. Then, movement is made by means of the fitting portions 17 of the side core 3 such that the contact portion 3*a* and the contact portion 3*b* respectively come into contact with the one end surface 2*a* of the center core 2 and the magnet 6. Accordingly, the internal space 21 of the side core 3 is shrunk in the X direction. If the side core 3 and the center core 2 are brought into contact with each other in this manner, variations in the dimensions in the X direction of the center core 2 and the magnet 6 are eliminated by the fitting portion 17. Thus, contact between the center core 2 and the side core 3 can be ensured.

As described above, in the internal combustion engine ignition coil 1, the side core 3 is composed of the first side core portion 12 and the second side core portion 13 separated from each other, and the fitting portions 17 which allow movement are formed at the overlap portions 14 between the first side core portion 12 and the second side core portion 13. Accordingly, the first side core portion 12 and the second side core portion 13 do not become apart from each other, and thus the internal combustion engine ignition coil 1 can be assembled without causing assembling workability for the internal combustion engine ignition coil 1 to deteriorate. In addition, the center core 2 and the magnet 6 can be accommodated by moving the first side core portion 12 and the second side core portion 13 by means of the fitting portions 17. Thus, even if the lengths of the center core 2 and the magnet 6 are increased, the side core 3 and the center core 2 can be kept in contact with each other at the surfaces thereof, whereby increase in the magnetic circuit resistance can be suppressed.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the specification of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1 internal combustion engine ignition coil
2 center core
3 side core
4 primary coil
5 secondary coil
6 magnet
7 case
8 primary bobbin
9 secondary bobbin
10 core cover
11 insulation resin
12 first side core portion
13 second side core portion
14 overlap portion
15 contact section
16 swaged portion
17 fitting portion
18 elongated hole
19 projection
20 contact surface

The invention claimed is:

1. An internal combustion engine ignition coil comprising:

a center core;

a primary coil provided on an outer side of the center core;

a secondary coil provided on an outer side of the primary coil; and a side core provided on an outer side of the primary coil and the secondary coil and formed by stacked electromagnetic steel sheets, the side core having one contact portion in contact with one end surface of the center core, the side core having another contact portion in contact with another end surface of the center core with a magnet therebetween, wherein the side core is composed of a plurality of side core portions fitted to each other to be movable relative to each other in a longitudinal direction of the center core, the side core has an overlap portion at which electromagnetic steel sheets of the side core portions adjacent to each other are separated at different locations and overlap with each other, and a fitting portion which allows the side core portions adjacent to each other to move relative to each other, is formed on the overlap portion, and at the fitting portion, a projection is formed on one of the side core portions and an elongated hole is formed in another one of the side core portions.

2. The internal combustion engine ignition coil according to claim 1, wherein the side core has the fitting portion at each of two locations, and the side core is formed in an O shape by using two side core portions which each have a U shape and in which division locations of the electromagnetic steel sheets are shifted between each electromagnetic steel sheet.

3. The internal combustion engine ignition coil according to claim 2, wherein electromagnetic steel sheets that are in a same layer among the electromagnetic steel sheets have contact surfaces at which the electromagnetic steel sheets in the same layer are kept in contact with each other during movement.

4. The internal combustion engine ignition coil according to claim 3, wherein a periphery of the side core is covered by an elastic resin material.

5. The internal combustion engine ignition coil according to claim 1, wherein the side core has the fitting portion at one location, and the side core is formed in a U shape by using two side core portions which each have an L shape and in which division locations of the electromagnetic steel sheets are shifted between each electromagnetic steel sheet.

6. The internal combustion engine ignition coil according to claim 5, wherein electromagnetic steel sheets that are in a same layer among the electromagnetic steel sheets have contact surfaces at which the electromagnetic steel sheets in the same layer are kept in contact with each other during movement.

7. The internal combustion engine ignition coil according to claim 6, wherein a periphery of the side core is covered by an elastic resin material.

8. The internal combustion engine ignition coil according to claim 1, wherein electromagnetic steel sheets that are in a same layer among the electromagnetic steel sheets have contact surfaces at which the electromagnetic steel sheets in the same layer are kept in contact with each other during movement.

9. The internal combustion engine ignition coil according to claim 8, wherein a periphery of the side core is covered by an elastic resin material.

* * * * *